US005800027A

United States Patent [19]

Dunn

[11] Patent Number: 5,800,027

[45] Date of Patent: Sep. 1, 1998

[54] BROCHURE DISPLAY CASE

[76] Inventor: Gary D. Dunn, 2368 Podocarpus Way, Clearwater, Fla. 34619

[21] Appl. No.: 829,231

[22] Filed: Mar. 31, 1997

[51] Int. Cl.[6] ..... A47F 3/00

[52] U.S. Cl. ..... 312/138.1; 40/124.2; 40/654.01; 16/225; 220/339; 220/478; 312/245; 312/183; 312/120; 312/123

[58] Field of Search ..... 312/245, 183, 312/188, 187, 120, 123, 138.1; 40/124.2, 649, 661.06, 654.01; 16/225; 220/339, 4.23, 480, 478, 476; 232/1 D, 17, 28

[56] References Cited

U.S. PATENT DOCUMENTS

| | | | |
|---|---|---|---|
| D. 294,908 | 3/1988 | Childress . | |
| D. 328,473 | 8/1992 | Mayden . | |
| 619,190 | 2/1899 | Knappenberger et al. | 312/120 |
| 708,822 | 9/1902 | Miller et al. | 311/123 |
| 755,962 | 3/1904 | Sullivan et al. . | |
| 1,219,657 | 3/1917 | Melchet | 312/123 X |
| 2,095,227 | 10/1937 | Brown | 312/245 |
| 3,027,215 | 3/1962 | Duncan | 312/245 |
| 3,241,901 | 3/1966 | Waybright | 312/245 X |
| 4,103,980 | 8/1978 | Silva | 312/245 X |
| 4,312,393 | 1/1982 | Green | 40/124.2 X |
| 4,929,039 | 5/1990 | Thomas et al. | 312/245 X |
| 5,392,544 | 2/1995 | Price . | |
| 5,564,166 | 10/1996 | Roy | 24/3.11 |

*Primary Examiner*—Peter M. Cuomo
*Assistant Examiner*—Stephen Vu
*Attorney, Agent, or Firm*—Terrance L. Siemens

[57] ABSTRACT

A display case for displaying and dispensing promotional literature, business cards, and the like at unattended sites. The case has a flat base which is supported on one or two nails driven into a supporting environmental surface. The base has a rain hood for protecting papers contained within the display case. A transparent or translucent door is hinged at the bottom to the base, and inclines forwardly to reveal a first or principal pocket containing brochures and a second pocket supported in piggyback fashion on the first pocket. The door has a forwardly bent tab at the top for grasping the door when opening the same. Transparent or translucent nature of the door reveals brochures contained within the display case. The second pocket is smaller, and is preferably dedicated to containing business cards. The hinge is preferably a live hinge fabricated from an elastic material, so that the hinge urges the door into a closed position.

6 Claims, 2 Drawing Sheets

BROCHURE DISPLAY CASE

BACKGROUND OF THE INVENTION

1.Field of the Invention

The present invention relates to an advertising display case for displaying and dispensing business cards and larger brochures. The display case comprises a stationary rear member and a door hinged to the rear member. The door has a first pocket for displaying and dispensing brochures or the like, and a second pocket for storing and dispensing cards.

2. Description of the Prior Art

When selling merchandise, it is frequently desirable to make descriptive literature and small cards imprinted with data corresponding to the name, address, and telephone number of an associated vendor or agent available to passersby at unattended facilities. Descriptive brochures and business cards are well known avenues for disseminating information important to those contemplating purchasing or leasing commercially available goods and services. However, maintaining a supply of brochures and business cords in an orderly, unattended display, particularly outdoors, may present problems.

A wall mounted card holder is shown in U.S. Pat. No. 5,392,544, issued to Gordon B. Price on Feb. 28, 1995. This card holder includes a pocket for displaying and dispensing business cards. A larger graphic display, such as photograph, is permanently embedded in the holder proximate the pocket. Unlike Price's device, the present invention includes a hinged door on which two display pockets are mounted. Cards are held in one pocket, and larger graphic displays, such as brochures, are held in the other pocket. Unlike Price, both cards and larger brochures are removably displayed in the present invention.

Other card holders are shown in U.S. Pat. Nos. 755,962, issued to Michael J. Sullivan and William T. Sullivan on Mar. 29, 1904, Des. 294,908, issued to Edward N. Childress on Mar. 29, 1988, and Des. 328,473, issued to Henry R. Mayden on Aug. 4, 1992. In this latter group, plural pockets are featured in the patents to Sullivan et al. and Childress. However, unlike these devices, the present invention incorporates a hinged door on which two pockets for storage and display of cards and brochures are disposed. The prior art devices fail to include a hinged door which must be opened to provide access to cards and brochures.

None of the above inventions and patents, taken either singly or in combination, is seen to describe the instant invention as claimed.

SUMMARY OF THE INVENTION

The present invention provides a display case suitable for mounting at an unattended site and displaying and enabling ready removal of brochures, business cards, and similar sales promotional literature. The display case comprises a base which is removably attached to a vertical environmental surface and provides a rain hood for protecting the promotional literature. Two holes for enabling mounting upon a nail extend through the base. A door is hinged to the base in such a manner as to incline forwardly, thereby revealing two pockets containing the promotional literature.

The principal pocket uses the door as its front wall, remaining walls of the principal pocket being attached to the rear surface of the door. The door is transparent or translucent, thereby revealing indicia appearing on the promotional literature even when the door is closed. This arrangement is useful in attracting attention of passersby who may be potential customers, and prompting passersby to remove the literature. When the door is opened, the second, smaller pocket is revealed. In the prefered embodiment, the principal pocket contains brochures, and the second pocket contains business cards.

The second pocket is disposed in piggyback fashion on the rear surface of the first pocket. When an interested passerby has opened the door, the second pocket is revealed. Therefore, the initial visual impression is not unduly encumbered by a display of many types of promotional literature. The passerby is free to concentrate on only one piece of literature, and additional promotional materials become available only to those who show deeper interest.

The door is connected to the base by a live hinge formed from an elastic material. This construction urges the door shut when not being grasped. Therefore, the door retracts automatically within the rain hood when no one is partaking of available promotional materials. The door has a forwardly projecting finger pull in the form of a downwardly bent tab terminating the door member. This construction enables the door to cooperate in maintaining effectiveness of protection against rain, and is also economical in fabrication of the novel display case.

Accordingly, it is a principal object of the invention to provide a display case for displaying and dispensing papers and similar materials at an unattended location.

It is another object of the invention that papers and similar materials be protected against rain.

It is a further object of the invention to provide a door affording access to displayed materials which closes automatically when not being opened by a passerby.

Still another object of the invention is that the door include a finger pull and cooperate in providing protection against rain.

An additional object of the invention is to reveal further promotional materials after an interested passerby has opened the novel display case.

It is again an object of the invention to enable ready mounting of the display case on a vertical environmental surface.

Yet another object of the invention is enable segregated storage of at least two types of promotional information within the display case.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
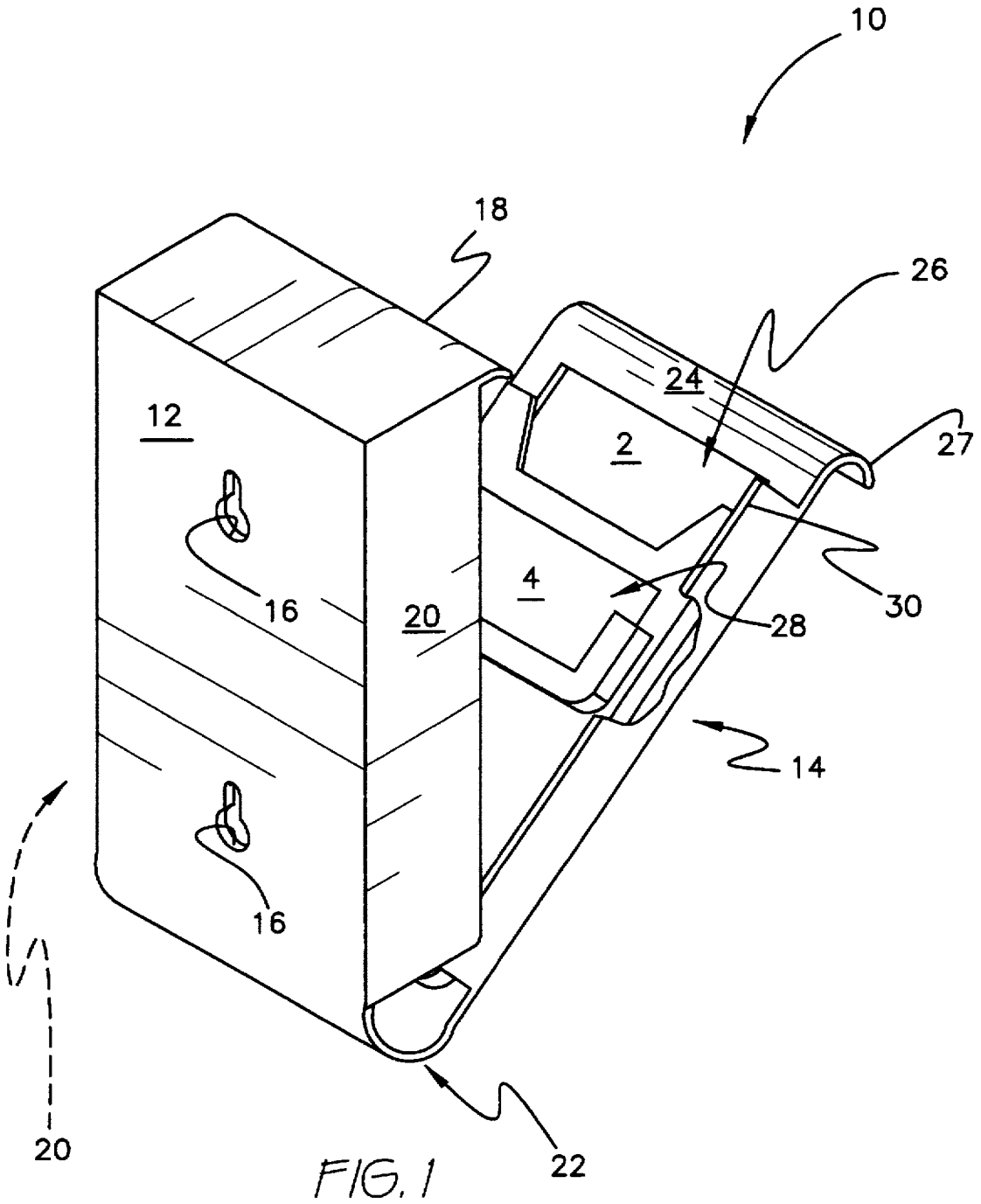
FIG. 1 is an environmental, rear perspective view of the invention.

Turning now to FIG. 1 of the drawings, novel dispensing display case 10 will be seen to comprise a planar base 12 pivotally supporting an inclining door 14. Base 12 has a nominal thickness characteristic of the constituent material from which it is fabricated. This thickness is not critical. In its normal, operative orientation, base 12 is vertically oriented.

Typically, base 12 is mounted on a vertical environmental surface by nails (not shown) or similar fasteners which protrude through holes 16 after display case 10 is placed over the heads of the fasteners. Mounting holes 16 are disposed in vertical registry with one another. According to well known practice for accommodating fasteners having enlarged heads, each mounting hole 16 has a configuration including a circle and a relatively narrow slot disposed above and intersecting the circle. This configuration is commonly referred to as a keyhole slot. A rain hood 18 projects forwardly from base 12. Preferably, rain hood 18 has vertically oriented side walls 20 which also project forwardly from base 12. Note that in the Figs. the rain hood 18 extends out past door 14 when it is in the closed position (see FIG. 2).

Door 14 has a hinge 22 pivotally attaching door 14 to base 12 so as to be movable between a closed position (shown in FIG. 2) wherein door 12 is disposed beneath rain hood 18, and an open position (again referring to FIG. 1), wherein door 12 inclines away from base 12. In the open position, door 12 affords access to its rear surface 24. A first or principal pocket 26 open at its top end for inserting, storing, and removing papers 2. It is contemplated that this pocket could be hinged or otherwise jointed so that it could be biased forwardly so as to hold up papers 2 and allow them to be grasped one at a time.

Papers 2 are visible through the front panel of door 14 in both the open and closed positions, since door 14 is fabricated from a transparent or translucent material. Door 14 has a forwardly projecting finger pull 27 attached thereto, or, preferably, formed integrally therewith by bending the top of door 14 to form a downwardly bent tab.

A second pocket 28 is carried upon rear surface 24 of door 14. Second pocket 28 is smaller in width and height compared to pocket 26, and is preferably dimensioned and configured to contain smaller papers, such as business cards. Second pocket 28 enables additional papers 4 or other graphic material to be available to a person opening door 14. Second pocket 28 segregates papers 4 from papers 2.

Of course, the precise nature and purpose of information contained in papers 2 and 4 and other literature enclosed within and offered by novel display case 10 are not critical. Therefore, materials devoted to purposes other than sales will equally enjoy the benefits of the invention.

Display case 10 includes biasing means for urging door 12 into the closed position. Although a separate spring (not shown) could be provided for this purpose, it is preferable that hinge 22 satisfy functions of both a hinge and a spring. This is accomplished by causing hinge 22 to be a live hinge formed from an elastic material integral with door 14 and base 12. It should be emphasized that in the embodiment shown, the elastic hinge portion is adapted to hold the door 14 and the base 12 in the closed relationship seen in FIG. 2. This construction is advantageous since it enables display case 10 to be fabricated by molding a suitable synthetic resin, thereby eliminating as many fabrication steps and separate parts as may be feasible.

Figure 2:
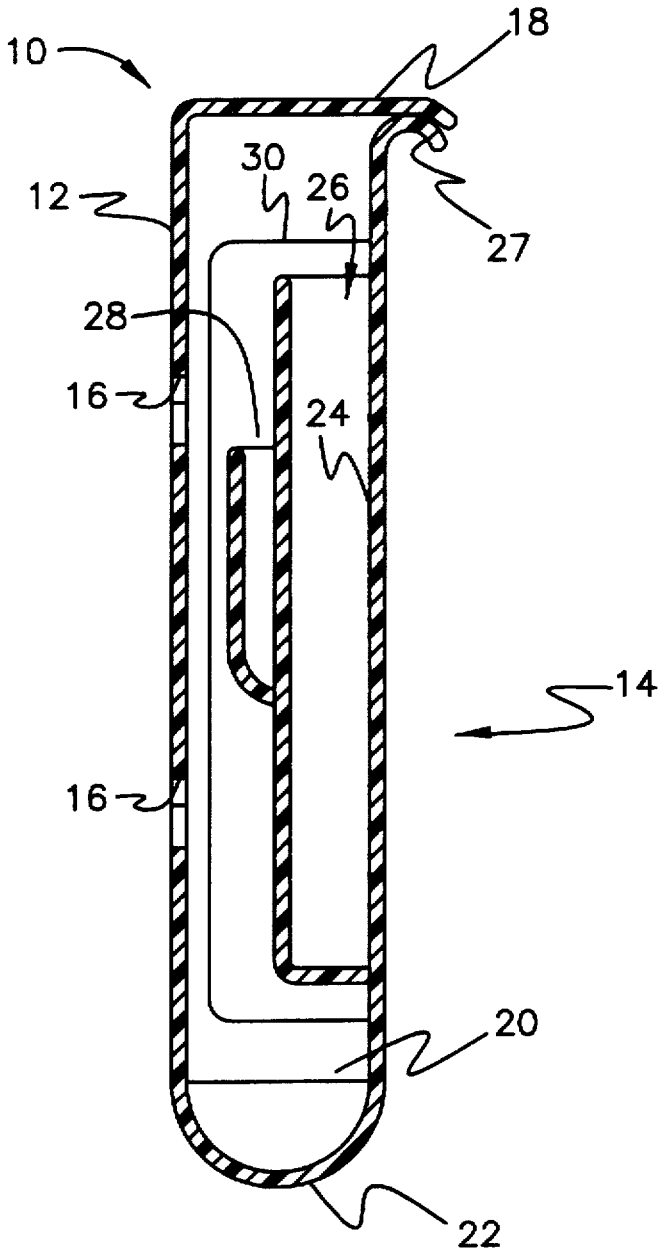
FIG. 2 is a side elevational, cross sectional view of the invention.

FIG. 2 provides a side elevational view showing interfit of the various components of display case 10 with door 14 in the closed position. Door 14 has rearwardly projecting, vertically oriented side walls 30 which complement side walls 20 of base 12 to further improve protection against rain. Examination of FIG. 2 will reveal that display case 10 is quite compact and well protected against rain in the closed condition. Hinge 22 is located at the bottom of door 14 and base 12, so that the respective ends of door 14 and base 12 can be downwardly bent to define the end of rain hood 18 and finger pull 27.

Although it is contemplated that molding display case 10 from a suitable synthetic resin, such a polycarbonate, is most economical and effective, such fabrication technique is not critical. Alternatively, display case 10 may be built up, or assembled from a plurality of individual parts by thermal or sonic welding, adhering, by using fasteners, or in any other suitable way.

It would be possible to vary certain features from the embodiments presented above. For example, door 14 may hinge at a side or top thereof, if desired, although such practice would likely sacrifice some degree of effectiveness of protection against rain. Also, pockets 26 and 28 may be varied in their relative dimensions and positions. Additional pockets 26 and 28 may be added, if desired. Mounting holes 16 may be varied in their size, configuration, location, and number, and may include standoffs for spacing display case 10 away from its supporting environmental surface, if desired.

It is to be understood that the present invention is not limited to the embodiments described above, but encompasses any and all embodiments within the scope of the following claims.

I claim:

1. A display case for the display and dispensing of brochures and cards, said display case comprising:

a base portion, said base portion being substantially planar and including means to attach said base portion to an environmental surface, said base portion including forwardly projecting side walls and a forwardly projecting rain hood;

a door portion adapted to fit within said base portion between said forwardly projecting side walls and underneath said forwardly projecting rain hood where said door portion also includes a finger pull;

an elastic hinge connecting said base portion and said door portion, where said elastic hinge is configured such that said door portion is maintained within said forwardly projecting side walls and underneath said forwardly projecting rain hood of said base portion when said display case is at rest;

where said door portion further includes a first pocket disposed to face said base portion such that said first pocket holds printed material enclosed within said forwardly projecting side walls and said forwardly projecting rain hood of said base portion when said display case is at rest and where said finger pull is disposed to fit underneath said projecting rain hood of said base portion when said display case is at rest and said finger pull is used to resiliently deform said elastic hinge such that said door portion tilts forwardly away from said base portion and said pocket containing the printed material is accessible to a user.

2. The display case according to claim 1, wherein said attachment means comprises vertically aligned keyhole slots.

3. The display case according to claim 1, wherein said door portion is transparent, so that printed material is visible when said display case is closed.

4. The display case according to claim 1, wherein a second pocket is located on said first pocket, said second pocket also facing said base portion.

5. The display case according to claim 4, wherein said attachment means comprises vertically aligned keyhole slots.

6. The display case according to claim 4, wherein said door portion is transparent, so that printed material is visible when said display case is closed.

* * * * *